United States Patent [19]

Csapody

[11] Patent Number: 4,678,958

[45] Date of Patent: Jul. 7, 1987

[54] HIGH PRESSURE SODIUM VAPOR LAMP WITH IMPROVED COLOR REPRODUCTION INDEX

[75] Inventor: Miklós Csapody, Budapest, Hungary

[73] Assignee: Tungsram Rt., Budapest, Hungary

[21] Appl. No.: 737,260

[22] Filed: May 23, 1985

[30] Foreign Application Priority Data

Jun. 12, 1984 [HU] Hungary ..... 2256/84

[51] Int. Cl.[4] ..... H01J 1/02

[52] U.S. Cl. ..... 313/15; 313/19

[58] Field of Search ..... 313/15, 19, 25, 39

[56] References Cited

U.S. PATENT DOCUMENTS 2,267,821 12/1941 Elenbaas ..... 313/25 X 3,721,846 3/1973 Cohen ..... 313/15

FOREIGN PATENT DOCUMENTS 494832 11/1938 United Kingdom ..... 313/15

*Primary Examiner*—Palmer C. DeMeo

*Assistant Examiner*—Sandra L. O'Shea

*Attorney, Agent, or Firm*—Gabriel P. Katona

[57] ABSTRACT

The invention relates to a high pressure sodium vapor lamp having improved color reproduction index, which has a discharge vessel (1) placed in an outer envelope (10) and at least a pair of electrodes (4,5) and a filling comprising of at least one additive material and a fill gas, as well as a pair of current conductors (6,7) for supplying current for the electrodes (4,5). The essence of the invention resides in that especially in the case of high pressure sodium vapor lamps of low output for the increasing of the color reproduction index filaments (2,3) are arranged at the ends and outside of the discharge vessel (1) and which during the entire operation of the discharge vessel (1) are connected in series therewith.

1 Claim, 1 Drawing Figure

HIGH PRESSURE SODIUM VAPOR LAMP WITH IMPROVED COLOR REPRODUCTION INDEX

FIELD AND BACKGROUND OF THE INVENTION

The present invention relates to a high pressure sodium vapour lamp with improved color reproduction index, which in an outer bell or envelope contains a ceramic discharge device having at least a pair of electrodes as well as a pair of current supply lines for the current supply of the electrodes, wherein the outer bell contains a filling comprising sodium introducing exclusively in the form of an amalgam and a ignition gas (see IES Lighting Handbook, 1981, pages 8–42). The arrangement according to the invention is especially suitable for improving the color reproduction index of high pressure sodium vapour lamps of low (from 16 to 100 w) output.

In projecting high pressure sodium vapour lamps of higher color reproduction as well as one lying close to incandescent lamps, a color temperature of about 2500K represents the theoretical possibilities of improvements of the parameters which is known to specialists in the field: the temperature of the end region (the so-called cold chamber) of the discharge vessel must be increased and thereby the vapour pressure of the sodium can reach a higher value as well, than at lower temperatures. The increase of the vapour pressure of the sodium brings about a widening of the spectrum of the generated light, which leads to an improvement of the color reproduction. In the case of high pressure sodium vapour lamps of about 100 w and having outputs higher, the necessary increase of the temperature of the cold chamber required for the improvement of the color reproduction index is brought about, in first instance, in such a manner, that at the end of the discharge vessel metallic cradles are arranged, which are made from a metal sheet (for example, from niobium), which reduce the infrared emission tendency of the end regions. Such solution is, for example, found in the lamp of the type LU250/DX of the General Electric Corp. The important disadvantage of such type of solution resides in the slow warming up, as well as in the condition that the necessary increase in the temperature of the cold chamber can be achieved in a given manner only at lamp outputs exceeding 150 w. Under such output the lamps will exhibit a too large passive heat radiating upper surface with respect to the input power and, therefore, to attain the desired higher temperature is impossible, or to attain it, a very high wall loading of the discharge vessel would be necessary, which would lead to unresolvable problems and, particularly, to a shortening of the operating life, as well as to a constant reduction of the light output of the light source. For similar reasons a warming up of the discharge vessel for an extended period of time, involving the above-mentioned lamp, becomes a characteristic, which, especially in interior applictions, in many times, is inadmissible. The increase of the upper surface loading of the discharge vessel gives, therefore, especially in the case of high pressure sodium vapour lamps of low outputs and small dimensions, no guidance which could be followed in an endeavor to improve the color reproduction index in order to increase the color temperature.

In the article "50 w Super High-Pressure Sodium Lamp" by Y. Ogata et al (Illum. Eng. Inst. Japan, Conference 1983, Paper No. 61) a ceramic discharge vessel of special shape is illustrated for attaining the above object. The special shaping means a reduction of the ceramic pipe portion at both of the electrodes, whereby the temperature of the cold chamber can be increased. Such shaping makes possible the attaining of the set object according to experiments, however, the manufacturing of such narrowed down ceramic pipe presents a difficult technicological problem, which results in increased manufacturing costs.

SUMMARY OF THE INVENTION

The object of the invention is, therefore, to provide such a high pressure sodium vapour lamp, wherein the temperature of the cold chamber is increased and, thereby, the color reproduction is improved, and which can be manufactured also in various embodiments of low output types, which are also characterized by a relatively simple construction.

Such object is solved by the provision of a high pressure sodium vapour lamp, which in an outer bell or envelope comprises a ceramic discharge vessel having at least a pair of electrodes as well as two current inputs for the current supply of the electrodes, wherein the outer envelope is provided with a filling comprising at least one additive material as well as a gas, and according to the invention, for the improving of the color reproduction index, at the ends of the discharge vessel in the exterior thereof, at each end a heating element is provided, which during the entire operation of the discharge vessel is coupled in series therewith.

The most important advantage of the proposed solution resides in that by using relatively simple measures, the temperature of the cold chamber can be considerably increased, whereby the improvement of the color reproduction and the maintenance of the color temperature in the region of 2400 to 2500K can be attained, and this can be had at high pressure sodium vapour lamps of low output. An additional advantage resides in that the heating element can be brought into a heated state practically without delay after the switching on of a discharge vessel, and thereby a quick heating up of the discharge vessel can be facilitated. Such influence becomes intensified thereby that during the heating up, a current flows through the heating element which exceeds the value of the operating current, whereby the turn-on current of the discharge vessel becomes increased. It can be of a further advantage, that after turning on of the discharge vessel (which in the ideal case occurs practically simultaneously with the turning on of the current flow), the heating element can, approximately without delay, glow, if it is dimensioned and constructed appropriately and, as a glow or incandescent spiral, it can form an additional light source at the beginning of the heating up of the lamp, when the discharge vessel still does not output any light.

The heating elements are constructed suitably into the high pressure sodium vapour lamp in such a manner, that each of them is coupled with the electrode arranged in the end of the discharge vessel adjacent thereto, as well as each is electrically coupled directly with the corresponding current input.

The heating elemens are suitably in the form of resistance elements, and formed as a coil, wherein the coils are preferably arranged at both ends of the discharge vessel, for example, on the closure elements thereof.

The heating elements comprise suitably tungsten, whereby each of them may act not only as a glimming body, but also as an effective light source.

BRIEF DESCRIPTION OF THE DRAWING

The invention becomes explained in more detail in the following, on hand of an exemplary embodiment, with reference to the attached drawing. The drawing illustrates in FIG. 1 a possible preferred embodiment of the high pressure sodium vapour lamp according to the invention.

DESCRIPTION OF THE PREFERRED EMBODIMENT

Figure 1:
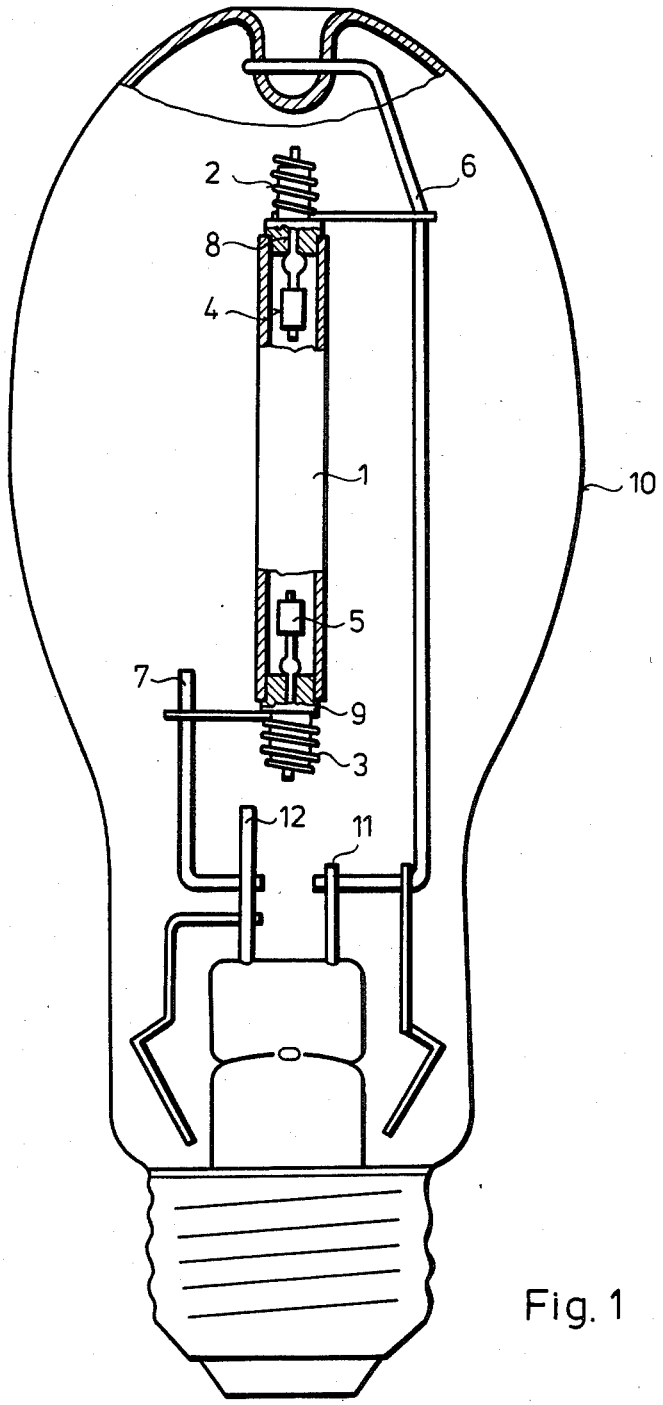

The high pressure sodium vapour lamp according to the invention (FIG. 1) comprises a discharge vessel 1 placed in an outer envelope 10. The discharge vessel 1 is manufactured from a ceramic material and has, at both ends, an electrode 4 and 5, which are fitted each, into a closure element 8 and 9. The closure elements 8 and 9 perform the closure of the discharge vessel 1. The discharge vessel 1 contains a filling, wherein the conventional additive materials and filling gases known in this area, are present. The closure elements 8 and 9 are in the form of plugs and comprise a portion which protrudes from the discharge vessel 1, wherein the heating elements 2 and 3 are arranged. In the case of a high pressure sodium vapour lamp of 50 w nominal output, the heating elements 2 and 3 are coiled from tungsten and are characterized by a power consumption each of 1.1 w. The discharge vessel 1 is at both ends connected with a current input 6 and 7, which is coupled to the electrodes 4 and 5. The coupling in general and, according to the invention, is performed by means of the heating elements 2 and 3, wherein the heating element 2 is inserted between the electrode 4 and the current input 6, the heating element 3 is inserted between the electrode 5 and the current input 7. The current input 6 and 7 are coupled with current conductors 11 and 12, which are led out to the terminals of a current supply source. The outer envelope 10 is closed in a vacuum tight fashion.

The use of the heating elements 2 and 3 enables the increase of the color reproduction index from the conventional value of 20 up to 65 and, even up to 85. A further advantage resides in that the heating-up time of the lamp (that is, the time required to attain 90% of the value of the light current with respect to the maximum) requires only 0.8 to 3 minutes, instead of the 3 to 5 minutes which is the case in conventional lamps and 5 to 10 minutes, in the case of the deluxe-type high pressure sodium vapour lamps.

I claim:

1. A high pressure sodium vapour lamp with improved color reproduction index, which comprises a ceramic discharge vessel in an outer envelope having at least a pair of electrodes and a filling comprising at least one additive material, such as sodium introduced exclusively in the form of an amalgam, as well as an ignition gas, a pair of conductors for the current supply of the electrodes, characterized in that at both ends of the discharge vessel and externally thereof a heating element is arranged, which during the entire operation of the discharge vessel are connected in series therewith, wherein each heating element is coupled to the electrode at the adjacently lying end of the discharge vessel as well as with one of the current conductors, said heating elements being formed as resistance coils and being arranged on closure elements which are provided for the closing of the discharge vessel, said heating elements incandescing and forming a mixed light lamp with said discharge vessel.

* * * * *